US008848954B2

(12) United States Patent
Balke et al.

(10) Patent No.: US 8,848,954 B2
(45) Date of Patent: Sep. 30, 2014

(54) SELF-ADJUSTMENT OF A HEARING AID AND HEARING AID

(75) Inventors: Mark Balke, Nürnberg (DE); Ulrich Giese, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 439 days.

(21) Appl. No.: 12/870,964

(22) Filed: Aug. 30, 2010

(65) Prior Publication Data

US 2011/0051964 A1 Mar. 3, 2011

(30) Foreign Application Priority Data

Aug. 28, 2009 (EP) ..... 09168936
Dec. 28, 2009 (EP) ..... 09180807

(51) Int. Cl.
*H04R 25/00* (2006.01)

(52) U.S. Cl.
CPC ..... *H04R 25/70* (2013.01)
USPC ..... 381/321; 381/312

(58) Field of Classification Search
USPC ..... 381/315, 314, 312, 60
See application file for complete search history.

(56) References Cited

U.S. PATENT DOCUMENTS

| | | | | |
|---|---|---|---|---|
| 4,471,171 | A | 9/1984 | Koepke et al. | |
| 5,604,812 | A * | 2/1997 | Meyer | 381/314 |
| 5,721,783 | A | 2/1998 | Anderson | |
| 2002/0044669 | A1 * | 4/2002 | Meyer et al. | 381/314 |
| 2003/0012391 | A1 * | 1/2003 | Armstrong et al. | 381/312 |
| 2003/0133578 | A1 * | 7/2003 | Durant | 381/60 |
| 2004/0028250 | A1 * | 2/2004 | Shim | 381/312 |
| 2004/0208331 | A1 * | 10/2004 | Chalupper | 381/314 |
| 2006/0074572 | A1 | 4/2006 | Bye et al. | |
| 2007/0189545 | A1 | 8/2007 | Geiger et al. | |
| 2007/0237346 | A1 * | 10/2007 | Fichtl et al. | 381/314 |
| 2008/0267434 | A1 * | 10/2008 | Schumaier | 381/314 |
| 2009/0074215 | A1 | 3/2009 | Schumaier | |

FOREIGN PATENT DOCUMENTS

| | | | |
|---|---|---|---|
| DE | 3205685 | A1 | 8/1983 |
| DE | 10104153 | A1 | 6/2002 |
| EP | 1073314 | A1 | 1/2001 |
| EP | 1813190 | A1 | 8/2007 |
| WO | 0078096 | A2 | 12/2000 |
| WO | 2009053517 | A1 | 4/2009 |

OTHER PUBLICATIONS

European Search Report dated Apr. 6, 2010.

* cited by examiner

*Primary Examiner* — Duc Nguyen
*Assistant Examiner* — Phan Le
(74) *Attorney, Agent, or Firm* — Laurence A. Greenberg; Werner H. Stemer; Ralph E. Locher

(57) ABSTRACT

The adjustment of the signal processing carried out by a hearing aid to the individual hearing loss of a user is intended to be simplified. For this purpose, a number of predefined adjustment programs, from which the user selects a suitable program by operating an operating element, are provided in the hearing aid. Neither a visit to a hearing aid acoustician nor special adjustment devices is/are required for adjustment.

12 Claims, 3 Drawing Sheets

SELF-ADJUSTMENT OF A HEARING AID AND HEARING AID

CROSS-REFERENCE TO RELATED APPLICATION

This application claims the priority, under 35 U.S.C. §119, of European application Nos. EP 09168936, filed Aug. 28, 2009, and EP 09180807, filed Dec. 28, 2009; the prior applications are herewith incorporated by reference in their entireties.

BACKGROUND OF THE INVENTION

Field of the Invention

The invention relates to a method for the self-adjustment of a hearing aid by a user to the individual hearing loss of the user. The invention also relates to a hearing aid for carrying out the method.

Every hearing aid should be individually adjusted to the respective user. Adjustment depends, in particular, on the hearing loss of the user, geometrical factors and the user's preferences. Measurements and tests are therefore needed to determine the hearing loss and the geometrical factors, and the user's personal requirements and wishes must be analyzed.

A hearing aid is generally adjusted to the individual hearing loss in a dialog between a hearing aid wearer and an acoustician. In this case, the hearing aid wearer is presented with different test signals which he subjectively perceives and for which he informs the acoustician of his impressions. The acoustician compares the perception of the hearing aid wearer with the impressions of the respective test signal of people with normal hearing. The acoustician uses the different perceptions to derive hearing aid parameter settings which generally result in improved adjustment of the hearing aid to the hearing aid wearer. This procedure is repeated until the person with impaired hearing subjectively perceives a number of test signals in a similar manner to a person with normal hearing.

Individual adjustment of a hearing aid in the manner described above is time-consuming and, in addition to a special apparatus, requires cooperation with a well-trained audiologist. It is therefore a decisive cost factor when supplying a person with a hearing aid.

Published, non-prosecuted German patent application DE 32 05 685 A1 discloses a hearing aid having a test tone generator which can be used to obtain audiological data relating to a user in a simple manner. The hearing aid automatically converts the audiological data into hearing aid parameter settings by which the hearing aid performs a transfer function in order to compensate for the measured hearing loss. This type of hearing aid adjustment requires time and a high level of attention from the user who is generally an elderly person.

Published, European patent application EP 1 073 314 A1 discloses a method for individually adjusting the signal processing of a hearing aid to a user, in which a measuring device is used to detect and evaluate different auditory unintended body signals of the user in order to automatically generate hearing-aid-specific adjustment parameter settings. The unintended body signals include, for example, otoacoustic emissions (OAE) or acoustically evoked potentials (AEP). This type of hearing aid adjustment requires special equipment and comprehensive knowledge of the operation of the latter.

Alternative methods use telemetric techniques (for example by means of telephone or the Internet) in order to acquire measurement data relating to the hearing loss of a user. International patent disclosure WO 2009/053517 A1 may be mentioned as an example of this.

International patent disclosure WO00/78096 A2 proposes the practice of dividing hearing losses into particular, typical clusters and keeping sets of hearing aid parameter settings for the different clusters, with the result that a hearing aid can be adjusted to an identified hearing loss cluster in a simple manner using a predefined set of parameter settings. The user thus receives a preset hearing aid and the user's wishes cannot be taken into account.

U.S. patent publication No. 2009/0074215 A1 discloses a programmable hearing aid which allows the user to select an acoustic configuration program from a number of stored configuration programs for individually adjusting the signal processing of the hearing aid to the user. In the known hearing aid, it is also possible to set a configuration mode in which configuration settings can be changed by using a switch or volume controller.

Hearing aids can be obtained online from the company "America Hears", which hearing aids are individually programmed in the company on the basis of audiograms sent to the company. For fine adjustment, each user receives a PC program and an interface for his hearing aid. The user can therefore himself set the gain and other signal processing features.

The company "Hearing Help Express" offers an online survey for selecting and setting a suitable hearing aid.

In recent years, hearing aids for openly supplying a user have become increasingly established on the market. In this case, open supply means that the auditory canal is not completely closed by the hearing aid or the earmold of the hearing aid but rather largely remains open. Direct sound can therefore still reach the eardrum even during supply by the hearing aid.

SUMMARY OF THE INVENTION

It is accordingly an object of the invention to provide a self-adjustment of a hearing aid and a hearing aid which overcome the above-mentioned disadvantages of the prior art methods and devices of this general type, which do not require special equipment or special knowledge or abilities during the self-adjustment of the hearing aid.

With the foregoing and other objects in view there is provided, in accordance with the invention a method for self-adjusting a hearing aid by a user to an individual hearing loss of the user. The method includes the steps of transferring the hearing aid to a self-adjustment mode, and selecting an adjustment program from a multiplicity of adjustment programs predefined in the hearing aid by means of an operating element. The adjustment programs which can be set in the self-adjustment mode differ in terms of a gain at least essentially only above a first threshold value and below a second threshold value of a frequency range which can be transmitted by the hearing aid. The self-adjustment mode is terminated and the hearing aid is operated on the basis of a selected adjustment program.

A hearing aid according to the invention is understood as meaning any device which provides an output signal that can be perceived as an acoustic signal by a user or contributes to providing such an output signal and which has means which are used to compensate for an individual hearing loss of the user or contribute to compensating for the hearing loss. They are, in particular, hearing aids which can be worn on the body or on the head, in particular on or in the ear, and can be fully or partially implanted. However, those devices whose main aim is not to compensate for a hearing loss are also concomitantly included, for example consumer electronic devices (televisions, hi-fi systems, MP3 players, etc.) or communication devices (mobile telephones, PDAs, headsets, etc.) which have, however, measures for compensating for an individual hearing loss.

An adjustment program in the sense of the invention should be understood as meaning a parameter set which is used to adjust the signal processing taking place in the hearing aid to the individual hearing loss of the user. Corresponding parameter settings are used, in particular, to determine the transfer function, that is to say the gain of an input signal entering the hearing aid on the basis of the signal frequency. However, in addition to the parameter values for the transfer function, the values of a multiplicity of other parameters can also be determined in an adjustment program. These parameters may relate, for example, to the compression, that is to say the gain on the basis of the signal level of the input signal, the noise reduction, the directivity, the feedback suppression, etc.

The hearing aid according to the invention stores a plurality of adjustment programs, that is to say parameter sets with firmly predefined parameter settings. The adjustment programs may be derived, for example, from the parameter settings which stem from a multiplicity of adjustment sessions actually carried out with arbitrary people with impaired hearing. Different types of impaired hearing can be taken into account, for example by forming clusters of gain and/or compression settings which are based on a multiplicity of measured audiograms. Keeping a limited number of adjustment programs in the hearing aid enables suitable adjustment to most hearing losses occurring in practice. The parameter settings for the individual adjustment programs can already be stored in the hearing aids immediately after the hearing aids have been manufactured by the manufacturer by programming the hearing aids.

The method according to the invention makes it possible for the user himself to adjust his hearing aid to his individual hearing loss in a simple manner. There is no need for special knowledge or abilities or special equipment for adjustment.

The adjustment of a hearing aid to different hearing environments should be distinguished from the adjustment of a hearing aid to the individual hearing loss of a user. The former is usually affected by selecting a suitable hearing program in which the hearing aid is operated in the respective hearing situation. Although this also influences the transfer function of a hearing aid and a suitable hearing program can also be manually selected by the user manually operating an operating element, the selection of the hearing program cannot replace the basic setting of a hearing aid for adjusting the signal processing to the individual hearing loss of the user. The parameter sets of the hearing programs for adjusting a hearing aid to different, common hearing environments or hearing situations (speech in a quiet environment, speech in the presence of noise, music, traveling in a car, telephone, etc.) can also be already defined and programmed immediately after a relevant hearing aid has been manufactured by the manufacturer.

For self-adjustment, the hearing aid is first of all transferred to a self-adjustment mode. This can be affected, for example, by operating an operating element which can also be fitted to a remote control. Alternatively, the self-adjustment mode can also be set after a battery has been inserted for the first time or after a relatively long interruption in the power supply, after the hearing aid has been switched on or after a reset switch has been operated, for example. The termination of the self-adjustment mode and the change into normal operation of the hearing aid, in which the signal processing is then carried out on the basis of the adjustment program selected, can likewise be carried out by the user operating an operating element or automatically, for example when an operating element was not operated for a particular period of time.

In the self-adjustment mode, an adjustment program which includes a transfer function with a relatively low gain, in particular with the lowest gain, is preferably first of all preset. In this case, the selection may also depend on the previous operating mode. For example, if the hearing aid was switched off normally before being switched on, the adjustment program set last is first of all activated in the self-adjustment mode. If, in contrast, a reset switch was operated, the predefined adjustment program with the lowest gain is then preset.

In the self-adjustment mode, the user is then able to select another predefined adjustment program and thus, in particular, another transfer function. The selection is made using at least one operating element which is advantageously present on the hearing aid in question. However, the operating element may also be on a further device, for example on a remote control for the hearing aid. An operating element which is present on the hearing aid or the remote control anyway is advantageously used for the selection, for example the volume controller or program selector switch. For example, operation of the volume controller in such a manner that, in the normal operating mode, the volume would be increased can result in the setting of an adjustment program and, in particular, a transfer function with a higher gain than the previously set transfer function. Conversely, operation of the volume controller in such a manner that, in the normal operating mode, the volume would be decreased would result in the setting of an adjustment program and, in particular, a transfer function with a lower gain than the previously set transfer function. The adjustment program set last in this manner before leaving the self-adjustment mode is then the selected adjustment program which is decisive for subsequent operation of the hearing aid. This adjustment program for adjusting the hearing aid to the individual hearing loss of the user then remains active until it is changed again by transferring the hearing aid to the adjustment mode and making a selection again in the described manner.

Adjustments during normal operation of the hearing aid should be distinguished from the selection of an adjustment program for fundamentally adjusting the hearing aid to the individual hearing loss of the user. In particular, the self-adjustment according to the invention does not include changes to the volume or sound setting or a changeover of the hearing program for adjusting the signal processing to different hearing environments.

The invention shows its advantages, in particular, in the case of hearing aids for an open supply. These are best suited to treating slight and medium hearing losses. Slight and medium hearing losses generally become noticeable mainly in the central and upper frequency ranges, to a lesser extent in the low-frequency range. Furthermore, in the case of an open supply, low-frequency sounds can pass to the eardrum virtually unimpeded. Therefore, it is generally not necessary to particularly amplify these sounds.

In the high-frequency range, during supply with a hearing aid which begins just at approximately 2 kHz, relatively tight physical limits are imposed on the gain by the open supply. Feedback increasingly occurs in this frequency range in the case of an excessively high gain. Since hearing losses are generally also particularly pronounced in the frequency range above 2 kHz, the largest possible gain at which the hearing aid in question can still be operated in a stable manner, that is to say with only a slight tendency for feedback, can thus be selected here.

It can be easily concluded from the statements made above that the hearing aid is adjusted primarily in the central frequency range of approximately 500 Hz to approximately 2 kHz in the case of an open supply. In a preferred method or hearing aid according to the invention, the transfer functions of the predefined adjustment programs, from which the user selects, therefore differ at least essentially only in the central frequency range which can be transmitted, for example from approximately 500 Hz to approximately 2 kHz. In the frequency range below this, below 500 Hz in this case, the hearing aid at least approximately does not provide any amplification. In the frequency range above this, above 2 kHz in this case, a large amount of amplification, in particular the largest possible amount of amplification, at which the hearing aid can still be reliably operated in a stable manner is always provided.

Each of the predefined adjustment programs which can be selected defines the transfer function and thus the frequency response of the hearing aid for the entire frequency range which can be transmitted. In this case, it is not possible, in particular, to cause a narrowband change, that is to say a change limited to a relatively narrow frequency range, in the transfer function, as would be possible, for example, by a hearing aid acoustician by a hearing aid adjustment device. Nevertheless, relatively good adjustment to most slight to medium hearing losses can be achieved by selecting a predefined adjustment program and thus a predefined transfer function. In this case, the selection is made, in particular, by the subjective feeling of the user depending on which of the predefined adjustment programs he feels to be the greatest help when wearing his hearing aid. There is no need for exact measurements of the hearing loss or complicated settings by an audiologist or acoustician.

A predefined adjustment program will be best selected when acoustic signals from the hearing aid are supplied to the user during self-adjustment and the user can therefore immediately experience the effect of different adjustment programs. For this purpose, test signals can be supplied to the hearing aid as input signals from the outside, for example via a computer or a stereo system, or else the test signals are stored in the hearing aid or are generated in an internal signal generator. The test signals supplied are then processed according to the currently set adjustment program. If the user is happy therewith, he terminates the self-adjustment mode. Otherwise, he selects another adjustment program.

The number of predefined adjustment programs, from which a selection can be made, is essentially only limited by the data memory provided for this purpose in the hearing aid. In the case of a simple hearing aid variant, only three different parameter sets can be stored, for example. In another variant, so many parameter sets can be stored that the impression of a smooth transition between the different adjustment programs arises when repeatedly or continuously operating the relevant operating element.

The self-adjustment of the hearing aid according to the invention is advantageously supplemented with individual restriction of the maximum volume generated by the hearing aid. For this purpose, the discomfort threshold at which, for example, the hearing aid increases the volume of an acoustic test signal until an operating element is operated is preferably automatically measured. Depending on the volume set last, the maximum volume which can be generated by the hearing aid is restricted at least for a particular frequency range. The compression characteristic, that is to say the dependence of the volume of the output signal on the volume of the input signal, can also be influenced thereby.

In addition, the self-adjustment according to the invention is advantageously also supplemented by measuring the open loop gain. The measurement result can be used to limit the maximum gain or to configure a feedback suppression device.

Other features which are considered as characteristic for the invention are set forth in the appended claims.

Although the invention is illustrated and described herein as embodied in a self-adjustment of a hearing aid and a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
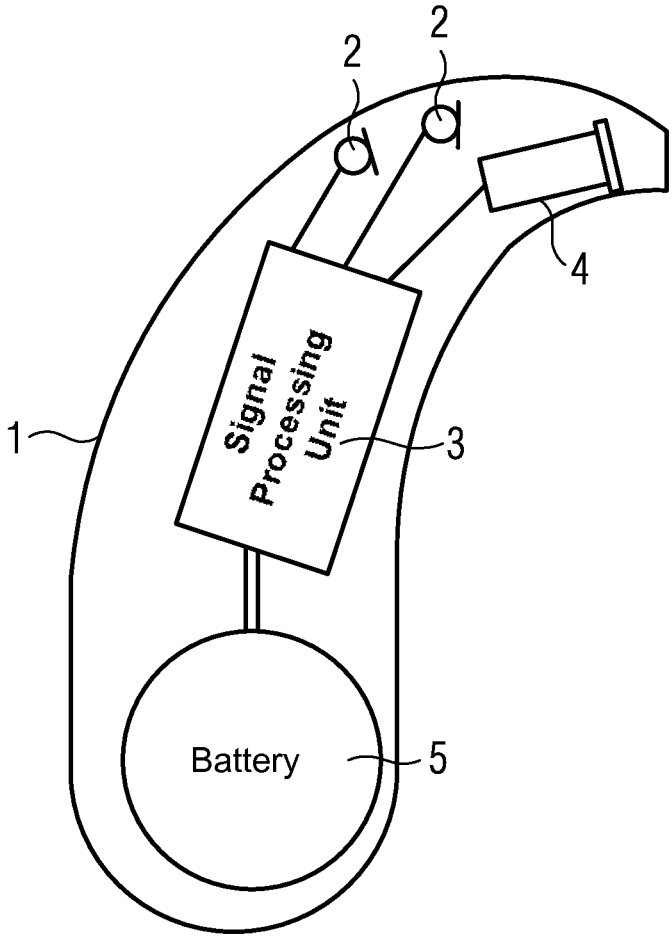
FIG. 1 PRIOR ART
FIG. 1 is an illustration showing a hearing aid according to the prior art.

Referring now to the figures of the drawing in detail and first, particularly, to FIG. 1 thereof, there is shown a highly simplified block diagram of the structure of a hearing aid, in particular of a hearing aid which can be worn behind the ear, according to the prior art. In principle, hearing aids have, as essential components, at least an input transducer, an amplifier and an output transducer. The input transducer is generally a sound receiver, for example a microphone, or an electromagnetic receiver, for example an induction coil. The output transducer is usually in the form of an electroacoustic transducer, for example a miniaturized loudspeaker or earpiece, or an electromechanical transducer, for example a bone conduction earpiece. The amplifier is usually integrated in a signal processing unit.

In the exemplary embodiment according to FIG. 1, a plurality of microphones 2 for picking up the sound from the environment are installed in a hearing aid housing 1 intended to be worn behind the ear. A signal processing unit 3 which is likewise in the hearing aid housing 1 processes and amplifies the microphone signals. The output signal from the signal processing unit 3 is transmitted to a loudspeaker or earpiece 4 which outputs an acoustic signal. The sound is transmitted to the user's eardrum, if necessary via a sound tube which is fixed in the auditory canal using an earmold. The hearing aid and, in particular, the signal processing unit 3 are supplied with power by a battery 5 which is likewise arranged in the hearing aid housing 1.

Figure 2:
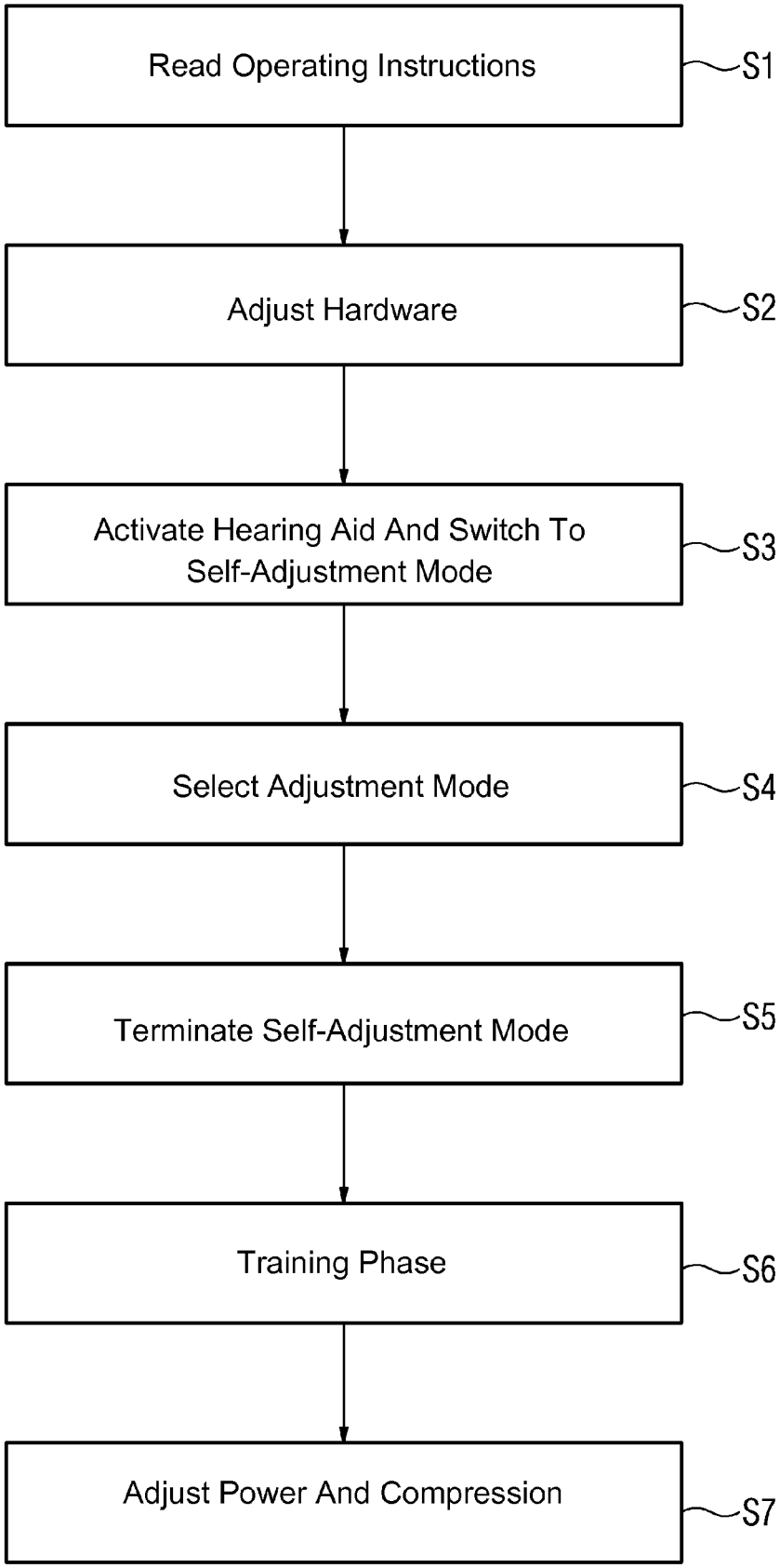
FIG. 2 is a flowchart for illustrating a self-adjustment according to the invention.

FIG. 2 is a flowchart for illustrating, by way of example, a possible procedure during the self-adjustment according to the invention.

In a first step S1, the user informs himself about the hearing aid and the self-adjustment procedure. This may be effected, for example, by reading operating instructions.

In a subsequent step S2, the hardware is first of all adjusted. For this purpose, the required length of a sound tube or an electrical signal line between the hearing aid which can be worn behind the ear and the earpiece which can be worn in the ear should be selected or the length should be accordingly adjusted. Furthermore, the size of the earpiece which is in the form of a universally suitable umbrella (ear tip or dome), in particular, should be selected from a number of earpieces of different sizes.

In a further step S3, the battery is inserted into the hearing aid and the hearing aid is fastened to the ear and switched on. The hearing aid preferably automatically detects first-time activation and first of all switches to the self-adjustment mode. However, the hearing aid can preferably also be transferred to the self-adjustment mode at any time by manually operating an operating element.

In the self-adjustment mode, a predefined adjustment program which, in comparison with the remaining predefined adjustment programs, predefines the transfer function with the lowest gain is first of all preset. It is then possible to change between the different adjustment programs by operating the volume controller in a further step S4. The different adjustment programs are organized in order of increasing gain, with the result that—based on normal operation of the hearing aid—rotation in the "louder" direction results in adjustment programs with a higher gain and rotation in the "quieter" direction results in adjustment programs with a lower gain.

During selection, the user can perceive an acoustic signal via the hearing aid. In this case, the signal processing for the acoustic signal is affected according to the currently set adjustment program. The user can therefore immediately detect the effects of different adjustment programs on the signal processing. The acoustic signal can be generated outside the hearing aid or can be stored in the hearing aid or else can only be generated in the hearing aid.

In a further step S5, the self-adjustment mode is terminated either by manually operating an operating element or automatically if none of the hearing aid operating elements is operated in the self-adjustment mode for a particular period of time. After the self-adjustment mode has been terminated, the adjustment program selected last in the self-adjustment mode is then decisive for the further signal processing. The adjustment program selected in this manner is preferably also decisive after the hearing aid has been switched off and switched on again.

The self-adjustment procedure can be extended or supplemented with the variants described below.

The first-time selection of an adjustment program can be followed by a training phase in a further step S6. The training phase means that the adjustment program selected last is not the only decisive adjustment program, but rather that the "antecedents", that is to say previously selected adjustment programs, also influence the signal processing currently being carried out by the hearing aid. In particular, the period of time for which the adjustment program, which was decisive before the last change, was retained determines the extent to which previously selected adjustment programs still influence the currently decisive parameter set. An example of this: the user selects an adjustment program and retains this program for a long period of time, for instance for several weeks. He then selects another predefined adjustment program with a substantially higher gain. This program is also immediately activated. However, after the hearing aid has been switched off and switched on again, the hearing aid automatically determines a new adjustment program in which the parameter settings essentially correspond to those of the adjustment program which was retained for a long time but are slightly closer to the parameter settings of the adjustment program set last. Only if the user more frequently selects adjustment programs with a higher gain within a short period of time and then retains these programs without change, in particular for a relatively long period of time, the hearing aid learns the changed user behavior and also predefines an adjustment program with a correspondingly high gain after the hearing aid has been switched off and switched on again. The hearing aid thus learns the user's preferences, in which case individual and/or only brief changes are not important when selecting a suitable adjustment program.

In the training phase, it is possible for only predefined adjustment programs to be set with the associated parameter sets from the hearing aid. Alternatively, it is also possible for the hearing aid to allow intermediate values for the predefined parameter sets when automatically determining parameter settings during the training phase.

Furthermore, the maximum output power and/or compression can also be individually adjusted in the course of self-adjustment in a further step S7. This is preferably associated with a measurement of the discomfort threshold, for which the hearing aid preferably outputs test signals of different loudness and the reactions of the user are detected. Narrowband noise, for example in the relevant frequency range of between 500 Hz and 2 kHz, in which the volume is gradually increased, is suitable, in particular, as a test signal. As soon as the noise becomes unpleasant for the user, the latter signals this by operating an operating element and the test signal stops. The volume of the signal generated last then predefines the discomfort threshold. Parameters relating to the gain or compression are then automatically set in such a manner that the discomfort threshold is not exceeded. The practice of expanding the self-adjustment to the adjustment of the maximum output power and/or the compression personalizes the hearing aid adjustment even further and takes account of safety aspects.

The procedure required for self-adjustment is advantageously described in operating instructions sold together with a corresponding hearing aid. These operating instructions may also be stored on a data storage medium with the associated multimedia possibilities, for example graphics, videos etc. However, the self-adjustment according to the invention is so simple that a brief description of the procedure in paper form generally completely suffices.

The invention affords the advantage that the user can himself adjust the signal processing taking place in the hearing aid to his individual hearing loss. He can carry this out in the real hearing environments preferred by him and thus outside artificial hearing environments, as are present for adjustment with a hearing aid acoustician. This leads to better results during adjustment. Neither an audiometer nor an adjustment device is required, and the amount of time needed for conventional adjustment is also dispensed with. The adjustment according to the invention is carried out without a special device or qualified personnel. It can be repeated at any time.

Figure 3:
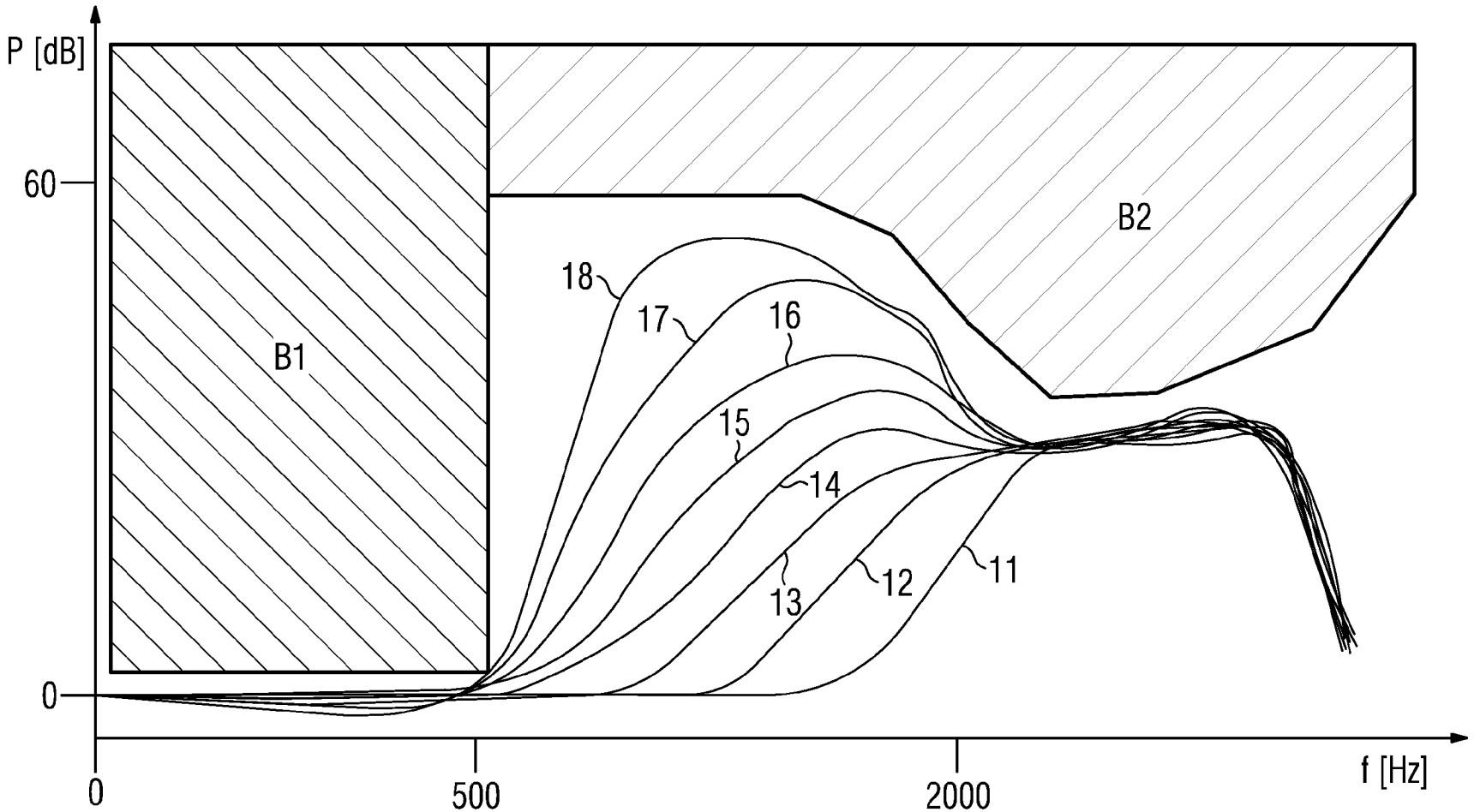
FIG. 3 is a graph showing different transfer characteristics which can be set.

FIG. 3 shows 8 different transfer functions of the hearing aid according to the invention, illustrated by the associated transfer characteristics. A gain P is illustrated against the frequency f using a logarithmic frequency scale. The transfer characteristics are provided with the reference symbols 11 to 18, to which the transfer functions are assigned in the order of the reference symbols with increasing gain. This means that the transfer characteristic 11 belongs to the transfer function with the lowest gain and the transfer characteristic 18 belongs to the transfer function with the highest gain with respect to a broadband input signal with a particular signal level. The 8 transfer characteristics belong to 8 predetermined adjustment programs which can be selected and the selection of which can be used by the user to adjust the relevant hearing aid to his individual hearing loss. In addition to the parameter settings which are decisive for the transfer functions, a multiplicity of further parameter settings of the relevant hearing aid can also be predefined by the respective adjustment program. These parameter settings may relate to the compression, the noise reduction, the directivity or the feedback suppression, for example.

If the hearing aid is in the self-adjustment mode, it is possible to change between the different adjustment programs and thus between the different transfer functions. For example, it is possible to change to transfer functions with a higher or lower gain by operating the volume controller of the hearing aid. It is also possible, for example in the case of a hearing aid having 8 hearing programs for different hearing environments, which can be directly set by 8 program selection keys on a remote control, for the 8 program selection keys to be directly used to select an adjustment program in the self-adjustment mode.

As is also clear from FIG. 3, the transfer characteristics mainly differ in the frequency range between a lower threshold value F1, at 500 Hz in the exemplary embodiment, and an upper threshold value F2, at 2 kHz in the exemplary embodiment. Below the threshold value F1, a large part of the amplified sound is lost through the vent of the hearing aid. This is greater, the larger the vent, in particular in the case of an open supply. Therefore, little can be achieved anyway in the case of an open supply with a gain below 500 Hz. A region B1 (illustrated using hatching) can therefore be disregarded below the threshold value F1 with regard to possible and useful transfer characteristics. Above the threshold value F2, a high gain is required on account of the hearing loss of most people with impaired hearing which is dominant in this frequency range. However, the gain is limited in this frequency range by the stability of the hearing aid with respect to feedback. On account of the tendency for feedback, a region B2 which is likewise illustrated using hatching is disregarded with respect to the profile of possible transfer characteristics for which operation without feedback cannot be ensured. Therefore, the profile of the transfer characteristics is predefined in this frequency range by the characteristic of a maximum possible gain which is clear from the lower boundary line of the region B2 or a particular "safety margin" with respect to this boundary line. Only the frequency range between the two threshold values F1 and F2, at 500 Hz and 2 kHz in the exemplary embodiment, for which there is a largely free choice therefore remains anyway.

The invention claimed is:

1. A method for self-adjusting a hearing aid by a user to an individual hearing loss of the user, which comprises the steps of:

transferring the hearing aid to a self-adjustment mode for fundamentally adjusting the hearing aid to the individual hearing loss of the user;

selecting an adjustment program from a multiplicity of adjustment programs predefined in the hearing aid by means of an operating element, the adjustment programs which can be set in the self-adjustment mode differing in terms of a gain at least essentially only above a first threshold value and below a second threshold value of a frequency range which can be transmitted by the hearing aid, the adjustment programs allowing no amplification to be carried out below said first threshold value and allowing maximum amplification above said second threshold value at which the hearing aid can still be reliably operated in a stable manner;

setting parameters relating to at least one of a transfer function, a compression, a noise reduction, a directivity or a feedback suppression by selecting the adjustment program;

setting different adjustment programs by means of the operational element disposed on the hearing aid or on a remote control separate from the hearing aid; and terminating the self-adjustment mode and operating the hearing aid on the basis of a selected adjustment program.

2. The method according to claim 1, which further comprises presetting a particular adjustment program in the self-adjustment mode.

3. The method according to claim 1, which further comprises presetting one of a predefined adjustment program with a relatively low gain and a predefined adjustment program with a lowest gain in the self-adjustment mode.

4. The method according to claim 1, wherein the operation of the operating element in the self-adjustment mode results in a setting of the adjustment program with a higher gain for a particular frequency range than a currently set adjustment program.

5. The method according to claim 1, wherein the operation of the operating element in the self-adjustment mode results in a setting of the adjustment program with a lower gain for a particular frequency range than a currently set adjustment program.

6. The method according to claim 1, which further comprises selecting from at least three predefined adjustment programs.

7. The method according to claim 1, which further comprises emitting an acoustic signal by the hearing aid for selecting the adjustment program, and the acoustic signal being emitted on a basis of a currently set adjustment program.

8. The method according to claim 1, wherein the hearing aid is in the self-adjustment mode after being switched on and the adjustment program selected last before the hearing aid was switched off is set.

9. The method according to claim 1, which further comprises:

automatically measuring a discomfort threshold;

increasing, via the hearing aid, a volume of an acoustic test signal until the operating element is operated; and defining at least one of a maximum gain and a maximum output power of the hearing aid at least for a particular frequency range on a basis of a volume set last.

10. The method according to claim 1, which further comprises measuring an open loop gain in the self-adjustment mode.

11. A hearing aid assembly, comprising:

a hearing aid programmed to:

transfer the hearing aid to a self-adjustment mode for fundamentally adjusting the hearing aid to an individual hearing loss of the user;

select an adjustment program from a multiplicity of adjustment programs predefined in said hearing aid by means of an operating element, the adjustment programs which can be set in the self-adjustment mode differing in terms of a gain at least essentially only above a first threshold value and below a second threshold value of a frequency range which can be transmitted by said hearing aid, the adjustment programs allowing no amplification to be carried out below the first threshold value and allowing maximum amplification above the second threshold value at which the hearing aid can still be reliably operated in a stable manner; and set parameters relating to at least one of a transfer function, a compression, a noise reduction, a directivity or a feedback suppression by selecting the adjustment program;

set different adjustment programs by means of the operational element disposed on the hearing aid or a remote control separate from the hearing aid; and terminate the self-adjustment mode and operating said hearing aid on a basis of a selected adjustment program.

12. The hearing aid assembly according to claim 11, wherein said hearing aid is simple to adjust to hearing needs of a user.

* * * * *